United States Patent [19]

Palma

[11] 4,423,843

[45] Jan. 3, 1984

[54] ELECTROMAGNETIC FUEL INJECTOR WITH ARMATURE STOP AND ADJUSTABLE ARMATURE SPRING

[75] Inventor: James D. Palma, Grand Rapids, Mich.

[73] Assignee: General Motors Corporation, Detroit, Mich.

[21] Appl. No.: 351,970

[22] Filed: Feb. 24, 1982

Related U.S. Application Data

[62] Division of Ser. No. 343,431, Jan. 28, 1982.

[51] Int. Cl.[3] ..... F02M 51/06

[52] U.S. Cl. ..... 239/585; 251/129; 251/141

[58] Field of Search ..... 239/584, 585, 600; 251/129, 141

[56] References Cited

U.S. PATENT DOCUMENTS

| | | | |
|---|---|---|---|
| 2,639,193 | 5/1953 | Wood, Jr. | 239/584 |
| 3,434,667 | 3/1969 | Chmura | 239/584 |
| 3,738,578 | 6/1973 | Farrell | 239/585 |
| 3,797,756 | 3/1974 | Voit et al. | 239/585 |
| 4,218,021 | 8/1980 | Palma | 239/585 |
| 4,247,052 | 1/1981 | Gray | 239/585 |

*Primary Examiner*—John J. Love
*Assistant Examiner*—Michael J. Forman
*Attorney, Agent, or Firm*—Arthur N. Krein

[57] ABSTRACT

An electromagnetic fuel injector has an axially adjustable nozzle assembly which provides an annular valve seat cooperating with a movable armature/valve member having at one end thereof a semi-spherical valve element and having at its opposite end a ball guide socket therein. A semispherical guide and stop member is positioned to be slidably received in the ball guide socket to guide the armature/valve member during reciprocation thereof and it is also used to provide a stop for the armature/valve member in the direction of its travel toward an associate pole piece so as to provide a fixed minimum air gap between the opposed working faces of these elements.

2 Claims, 1 Drawing Figure

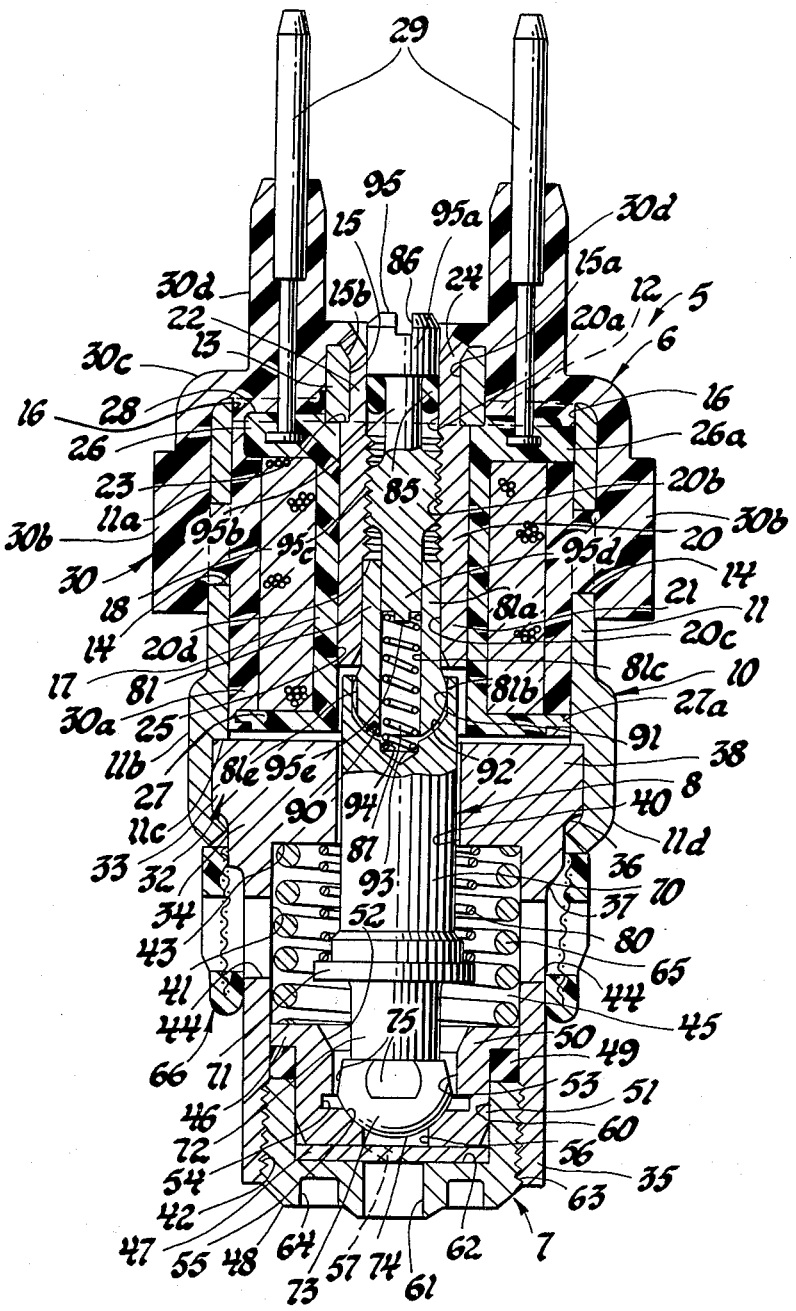
29
95
95a
30d
15
86
24
15a
30d
15b
12
5
22
20a
13
6
30c
16
28
16
26
26a
23
20b
85
11a
30b
95b
95c
95d
20
30b
30
14
18
21
11
81a
14
20d
20c
17
81
81b
81c
10
30a
25
27a
11b
91
38
27
81e
95e
92
8
90
94
40
11c
11d
33
32
87
36
93
37
70
34
52
80
43
65
41
44
44
45
75
50
49
66
71
53
51
46
60
72
56
54
35
63
42
47
55
48
64
73
57
74
61
62
7

ELECTROMAGNETIC FUEL INJECTOR WITH ARMATURE STOP AND ADJUSTABLE ARMATURE SPRING

This application is a division of copending U.S. patent application Ser. No. 343,431, filed Jan. 28, 1982 and assigned to the assignee of the present invention.

FIELD OF THE INVENTION

This invention relates to electromagnetic fuel injectors and, in particular, to such an injector having a guide means therein to guide one end of an armature and to provide a minimum fixed working air gap between the armature and a pole piece.

DESCRIPTION OF THE PRIOR ART

Electromagnetic fuel injectors are used in fuel injection systems for vehicle engines because of the capability of this type injector to more effectively control the discharge of a precise metered quantity of fuel per unit of time to an engine. Such electromagnetic fuel injectors, as used in vehicle engines, are normally calibrated so as to inject a predetermined quantity of fuel per unit of time prior to their installation in the fuel system for a particular engine.

In one such type electromagnetic fuel injector as shown, for example, in U.S. Pat. No. 4,247,052 entitled "Electromagnetic Fuel Injector" issued Jan. 27, 1981 to Leo A. Gray, a two-part valve means movable relative to an annular valve seat is used to open and close a passage for the delivery of fuel from the injector out through an injection nozzle having delivery orifices downstream of the valve seat. One part of this valve means is a sphere-like valve member having a flat on one side thereof and being spherical opposite the flat to provide a spherical seating surface for valve closing engagement with the valve seat. The other part of the valve means is an armature with a flat end face seated against the flat surface of the valve member in a laterally slidable engagement therewith.

An armature spring is positioned within the injector to normally bias the armature in a direction to effect seating of the valve member against the valve seat. A fixed minimum working air gap may be provided for in this type injector by the use of a stepped guide pin provided with a shoulder for abutment against a portion of the armature whereby to limit movement of the armature relative to the solenoid pole piece, the guide pin also being used to guide the armature during reciprocating movement thereof.

Because of the use of this type guide pin, a two-part valve means as described hereinabove, should be used otherwise, if a one-piece armature-valve member is used, close manufacturing tolerance must be maintained to insure concentricity of the seat for the valve with the guide pin.

SUMMARY OF THE INVENTION

Accordingly, a primary object of the present invention is to provide an improved electromagnetic fuel injector construction that advantageously utilizes a semi-spherical stop member for guiding and for limiting axial movement of a one piece armature/valve member in the direction toward the working surface of an associate pole piece whereby to establish a predetermined minimum working air gap between the opposed surfaces of the armature end of the armature/valve member and the pole piece.

Still another object of the present invention is to provide an electromagnetic fuel injector of the above type which includes features of construction, operation and arrangement, rendering it easy and inexpensive to manufacture and to calibrate both for the desired fuel flow and for dynamic response, which is reliable in operation, and in other respects suitable for extended use on production motor vehicle fuel systems.

The present invention relates to an electromagnetic fuel injector of the type having an axially adjustable nozzle assembly therein. This nozzle assembly provides an annular valve seat cooperating with a movable armature/valve member having at one end thereof a semi-spherical valve element. The armature/valve member is biased by an armature return spring means towards a valve closed position and is drawn towards the pole piece against the bias of this spring by current flow in the solenoid coil. The armature/valve member, under the spring bias, locates the valve element in a closed, centered position on the associate valve seat. A semi-spherical stop member slidable in a guide socket in the armature end of the armature/valve member is used to provide a guide and also a stop for the armature/valve member in the direction of its travel toward the solenoid pole piece so as to provide a fixed minimum air gap between the opposed working surfaces of the solenoid pole piece and the armature/valve member. The semi-spherical stop element is operable even for limited skewness of the armature/valve member relative to the axis of the pole piece.

In a preferred embodiment, the armature return spring means of the injector includes a trim spring loosely received in the pole piece with one end thereof in operative abutment against the armature/valve member to normally bias it in a valve closing direction. The injector is also provided with an externally accessible, driver-receiving abutment screw which abuts against the opposite end of the trim spring so as to vary the armature return spring means load, as desired, for the desired dynamic response of the armature/valve member upon energization of the solenoid coil.

For a better understanding of the invention, as well as other objects and further features thereof, reference is had to the following detailed description to be read in connection with the accompanying drawing.

The FIGURE is a longitudinal cross-sectional view of an exemplary embodiment of an electromagnetic fuel injector having an armature stop and armature guide arrangement in accordance with the invention incorporated therein, the armature/valve member of the injector being shown partly in elevation.

DESCRIPTION OF THE EMBODIMENTS

Referring now to the FIGURE, the embodiment of the electromagnetic fuel injector, generally designated 5, illustrated therein includes, as major components thereof, a solenoid assembly 6, a nozzle assembly 7 and an armature/valve member 8.

The solenoid assembly 6 includes a cupshaped, solenoid housing 10, made for example of SAE 1008-1010 steel, having a rim like, circular body 11 and an integral flange 12 extending radially inward from the upper end of body 11 portion. Body 11 is provided with a plurality of circumferentially spaced apart apertures 14 located intermediate its ends. In the construction shown, body portion 11 includes an upper portion **11*a* and a lower portion 11***b*, the latter both a greater internal diameter and a greater external diameter than the respective diameters of upper portion 11*a*, and an interconnecting flat shoulder 11*c*.

The flange 12 is provided with an integral central, upstanding boss 13 having an aperture 15 extending axially therethrough. Flange 12 is also provided with a plurality of through apertures 16, only two such apertures being seen in the FIGURE, that are circumferentially equally spaced apart and located radially outward of central aperture 15. Preferably, at least two diametrically opposite apertures 16 are of arcuate configuration for a purpose also to be described in detail hereafter. As shown, the aperture 15 through boss 13 is formed so as to provide a lower straight bore wall 15*a* and an upper beveled internal rim 15*b*.

Solenoid assembly 6 further includes a cylindrical, tubular pole piece 20 and a spool-like, tubular bobbin 17 supporting a wound wire solenoid coil 18.

In the construction illustrated, the pole piece 20 is provided with a cylindrical lower portion 21 of predetermined diameter, a cylindrical upper portion 22 of a reduced diameter corresponding to the internal diameter of aperture 15 and an interconnecting flat shoulder 23. In addition, the pole piece 20 is provided with a stepped bore therethrough which, starting from the top with reference to the FIGURE, defines an internal circular upper bore wall 20*a*, an intermediate internally threaded wall 20*b*, and a lower straight bore wall 20*c*, with the threaded wall 20*b* being of reduced internal diameter relative to the internal diameters of walls 20*a* and 20*c*. The walls 20*b* and 20*c* are interconnected by a shoulder 20*d*.

The pole piece 20 is fixed to the solenoid housing as by having the portion 22 of the pole piece 20 extending through the bore wall 15*a*, with the upper end crimped or swaged over against the rim 15*b* so as to define a retention flange 24 preventing axial movement of the pole piece in one direction. Axial movement of the pole piece in the opposite direction is fixed by abutment of shoulder 23 thereof against the lower rim edge of boss 13.

The bobbin 17, made of a suitable plastic material, such as glass filled nylon, is provided with a central through bore 25 of a diameter to slidably receive the lower portion 21 of pole piece 20 whereby the bobbin 17 is supported concentrically within the solenoid housing 10 and with the upper flange 26 thereof in abutment against the inside surface of the flange portion 12 of the solenoid housing 10.

The upper flange 26 and bottom flange 27 of bobbin 17 are provided with a plurality of circumferentially spaced apart lobes 26*a* and 27*a*, respectively, of a size whereby the effective outside diameters of these flanges are in press fit engagement with the internal wall of portion 11*a* of the solenoid housing 10. However, because of the relative small thickness of these flanges and of the material thereof, primary centering of and support of the bobbin 17 within the solenoid housing 10 is by means of the pole piece 20 and by means of an encapsulant member 30 to be described in detail hereinafter.

Bobbin 17 is also provided with a pair of diametrically opposed upright terminal leads 29, which project upward from bobbin flange 26 and from the opposed arcuate shaped bosses 28 thereon so as to project centrally up through the apertures 16 of corresponding arcuate shape in the solenoid housing 10 for connection to a suitable controlled source of electrical power, as desired. The opposite end of each such lead 29 is suitably connected, in a known manner, to a terminal end of the solenoid coil 18.

Preferably, the axial extent of bobbin 17 is preselected relative to the internal axial extent of the body 11*a* portion of the solenoid housing between the lower surface of flange 12 and the shoulder 11*c* so that, when the bobbin 17 is positioned in the solenoid housing 10, as shown in the FIGURE, an axial clearance will exist between the lower face of the bottom flange 27 of the bobbin 17 and the shoulder 11*c* of the solenoid housing 10, for a purpose to be described hereinafter.

Bobbin 17 is further supported within the solenoid housing 10 by means of an encapsulant member 30, made of a suitable encapsulant material, such as glass filled nylon, that includes a cylindrical portion 30*a* encircling the solenoid coil 18 and the outer peripheral edge of the lower flange 27 of the bobbin 17 and which is also in abutment against the inner surface of the upper portion 11*a* of body 11; a plurality of radial extending connectors 30*b* corresponding in number to the apertures 14; an outer cup-shaped outer shell 30*c* encircling the exterior upper portion 11*a* body 11 and flange 12, including the boss 13 thereof, of the solenoid body 10; and, a pair of diametrically opposed studs 30*d*, each of which encloses a terminal lead 20. As shown, the encapsulant material of the outer shell 30*c* portion extends into the apertures 16. Preferably, as shown, the encapsulant material of outer shell 30*c* and of studs 30*d* extends at least partly over the upper end of pole piece 20 in a manner to provide a central aperture through the outer shell 30*c*.

Preferably, as shown, the flange 27 of bobbin 17 is undercut at its lower outer peripheral edge to effect a lock with the cylindrical portion 30*a* of the encapsulant member 30 so as to further effect positive retention of the bobbin 17 within the solenoid housing 10.

Referring now to the nozzle assembly 7, it includes a nozzle body 32, of tubular configuration, having a circular upper portion 33, a circular intermediate portion 34 and a circular lower portion 35. Portions 34 and 35 are of successively reduced external diameters relative to the external diameter of upper portion 33. Portions 33 and 34 are interconnected by an external shoulder 36 and portions 34 and 35 are interconnected by an external shoulder 37.

The nozzle body 32 is fixed to the solenoid housing 10, with the outer peripheral edge portion of the flat upper surface 38 of the nozzle body 32 in abutment against shoulder 11*c*, as by inwardly crimping or swaging the lower end of body portion 11*b* at a location next adjacent to shoulder 36 to define a radially inward extending rim flange 11*d*.

Since as previously described, the axial extent of bobbin 17 is preselected to provide an axial clearance between its lower surface and the shoulder 11*c*, the nozzle body 32 can abut against the shoulder 11*c*. In addition, because of the increased rate of thermal expansion of the material of the bobbin 17 relative to the material of the solenoid housing 10, a sufficient clearance is thus provided for such expansion so that the bobbin will not press against the nozzle body 32.

Nozzle body 32 is provided with a central through stepped bore to provide an internal circular upper wall 40 and a lower wall 41. Wall 41 is of a greater internal diameter than that of wall 40 and is provided at its lower end with internal threads 42. The walls 40 and 41 are interconnected by a flat shoulder 43.

In addition, the nozzle body 32 is provided with a plurality of circumferentially spaced apart radial ports 44 in the lower portion 35 thereof which open into a fuel chamber 45 defined in part by the lower wall 41.

The nozzle assembly 7 further includes a valve seat element 46, a director plate 47 and a spray tip 48 with a seal ring 49 positioned between the valve seat element 46 and spray tip 48, in a manner to be described hereinafter.

Valve seat element 46 is provided with an upper flange 50 and with a reduced diameter body 51 depending therefrom, the latter being preferably tapered at its lower end, as shown, to effect its assembly into spray tip 48. A stepped central bore through the valve seat element 46 defines, in succession, starting from the top with reference to the FIGURE, an internal conical upper wall 52, an internal straight guide wall 53, an annular recess 54, a conical valve seat 55 and a lower wall defining a discharge passage 56.

The director plate 47 is provided with a plurality of circumferentially, equally spaced apart inclined and axial extending director passages 57. Preferably six such passages are used, although only one such passage is shown in the FIGURE. These director passages 57, of predetermined equal diameters, extend at one end downward from the upward surface of the director plate 47 and are positioned so that their lower outlet ends are located radially inward of the discharge passage 56 in the valve seat element 46.

The spray tip 48, of cup-shaped configuration, is provided with a circular internal upper wall 60 and a reduced diameter lower wall 61 that defines a passage for the discharge of fuel from the nozzle assembly. The walls 60 and 61 are interconnected by a flat shoulder 62.

As illustrated, the upper wall 60 of the spray tip 48 is of a suitable internal diameter whereby to slidably receive the body 51 portion of the valve seat element 46 and to receive the director plate 47. As shown, the director plate 47 is positioned so that it is sandwiched between the lower end surface of the valve seat element 46 and the internal shoulder 62 of the spray tip. Also as shown, the ring seal 49 is located so as to encircle the reduced diameter body 51 of the valve seat element 46 whereby it will be sandwiched between it and the internal wall 41 of the nozzle body 32.

In the construction shown, the outer peripheral surface of the spray tip 48 is provided with external threads 63 for mating engagement with the internal threads 42 of the nozzle body 32. Preferably these mating threads are of a suitable fine pitch whereby to limit axial movement of the spray tip a predetermined extent, as desired, for each full revolution of the spray tip 48 relative to the nozzle body 32.

The lower face of the spray tip 48 is provided, for example, with at least a pair of diametrically opposed blind bores 64 of a size so as to slidably receive the lug of a suitable spanner wrench, not shown. With this arrangement rotational torque may thus be applied to the spray tip 48 during assembly of the element to the nozzle body 32 and to effect axial adjustment of this element in the nozzle body 32 during flow calibration of the injector in a known manner, as described for example, in U.S. Pat. No. 4,218,021 Palma, entitled "Electromagnetic Fuel Injector".

As illustrated, a coil spring 65 is loosely positioned in the fuel chamber 45 whereby one end thereof abuts against the shoulder 43 and its opposite end abuts against the upper flange 50 surface of the valve seat element 46 so as to bias it into abutment against the spray tip 48, with the director plate 47 sandwiched therebetween.

To effect filtering of the fuel being supplied to the injector 5 prior to its entry into the fuel chamber 45, there is provided a fuel filter assembly, generally designated 66. The fuel filter assembly 66 is adapted to be suitably secured, as by a suitable press fit, to the nozzle body 32 in position to encircle the radial ports 44.

Referring now to the armature/valve member 8, this member, starting in succession from the top with reference to the FIGURE, includes an armature 70, an outward extending radial flange 71, a stud portion 72 and a valve 73. The armature 70 is of circular configuration and of a predetermined outside diameter whereby it is loosely reciprocable in both the bobbin bore 25 and in the wall 40 of the bobbin 17 and nozzle body 32, respectively.

As shown, the valve 73 is of semi-spherical configuration and of a predetermined radius whereby it is slidably received and guided by the guide wall 53 of the valve seat element 46 and whereby its spherical lower end defines a seating surface 74 for engagement with the valve seat 55. As illustrated, at least two, and preferably more suitable flats 75 are provided on the outer peripheral side surface of the valve 73, that is about its horizontal centerline with reference to the FIGURE, whereby each flat define a passage with the guide wall 53 for the flow of fuel. In the embodiment illustrated, four such flats 75 are provided on the valve 73 in circumferentially spaced apart relationship to each other.

To further effect axial guiding of the armature/valve member 8 during axial movement between a lowered position, as shown in the FIGURE, whereat valve 73 engages valve seat 55 and a raised position, there is provided an armature stop and guide member 81, which is operatively fixed to the pole piece 20.

The armature stop and guide member 81, associated with the pole piece 20, is made of a suitable physically hard material and is provided with an upper external straight wall portion **81*a* of a size so as to be suitably secured, as by a press fit, into the bore wall 20*c* of the pole piece 20 in abutment at its upper end against shoulder 20*d* and , a lower ball guide 81*b* portion that is of semi-spherical configuration and of predetermined external diameter. In addition, a bore 81*c* extends axially through the armature stop and guide member 81**.

The axial extent of the armature stop and guide member 81, as mounted in the pole piece 20, is such so that the ball guide **81*b* extends below the lower working face of the pole piece 20** a predetermined axial distance.

Referring again to the nozzle assembly 7, the associate armature/valve member 8 is guided for axial movement at its lower valve 73 end in valve seat element 46 in the manner described hereinabove. In accordance with the invention, the armature/valve member 8 is guided at its opposite end by means of the ball guide **81*b* of the armature stop and guide member 81**.

For this purpose the armature 70 of the armature/-valve member 8, which can be of circular cross-section along its entire axial extent, is provided with a ball guide socket 90 at its upper, free end. In the construction illustrated, socket 90 is defined by a circular straight internal guide wall 91 of an internal diameter so as to slidably receive the ball guide **81*b* of armature stop and guide member 81, a radial inward extending, conical guide stop seat 92 and, a spring guide bore wall 93 terminating at its lower end in a spring abutment shoulder 94. Preferably, the guide wall 91 and stop seat 92 surfaces of the armature 70** are suitably hardened.

The axial depth of the guide stop seat 92 from the upper working face of the armature 70 relative to the axial extent of the ball guide 81*b* from the opposed working face of the pole piece 20 is predetermined so that, when the armature/valve member 8 is in its lowered position, as shown, a predetermined axial gap will exist between the ball guide 81*b* and the guide stop seat 92. However, as the armature/valve member 8, upon energization of the solenoid coil 18, moves upward toward the pole piece 20, its upward movement will be limited by engagement of the guide stop seat 92 with the lower end of ball guide 81*b*. This point of engagement is predetermined so as to establish a predetermined minimum fixed working air gap, as desired, between the opposed working surfaces of the pole piece 20 and armature 70.

This above described guide arrangement for the armature/valve member 8, while guiding the upper end of the armature during reciprocating movement thereof does allow the armature/valve member 8 to operate with some level of its centerline skewness with respect to the pole piece 20 centerline without affecting the stroke parameter or hydraulic adherence (stiction) at the ball guide 81*b* and guide stop seat 92. Preferably, in order to prevent hydraulic lock, a suitable flat or a groove 81*e* is provided, for example, on the ball guide 81*b*.

The armature/valve member 8 is normally biased, in an axial direction, downward with reference to the FIGURE to the position shown, so that the valve 73 is in seating engagement with valve seat 55, by an armature spring biasing means which includes a coiled armature return spring 80 and a trim spring 87, both of predetermined forces.

As shown, the armature return spring 80 is positioned to loosely encircle armature 70 with one end thereof in abutment against the flange 71 of the armature/valve member 8 and its opposite end in abutment against the shoulder 43.

The trim spring 87, in turn, is positioned so that its force can be adjusted, as desired, through an externally accessible adjusting means. For this purpose, the trim spring 87 is loosely received in the cavity defined by bore wall 81*c* and in spring guide bore wall 93, in the armature stop and guide member 81 and armature 70, respectively. The lower end of the trim spring 87 is thus located so that it operatively abuts against the armature 70 while at its opposite end the trim spring is positioned to abut against an externally accessible adjustment screw 95.

The adjustment screw 95, in the construction illustrated, includes a head 95*a*, of a diameter to be slidably received in bore wall 20*a* of the pole piece 20, and a shank depending from the head, the shank including a reduced diameter shank portion 95*b*, an externally threaded screw portion 95*c* threadingly engaged with internally threaded wall 20*b* and a lower abutment portion 95*d* of a diameter to be slidably received by the bore wall 81*c* of the armature stop 81. As shown the abutment portion 95*d* terminates at an abutment surface and centering pin 95*e* for the upper end of the trim spring 87.

As illustrated, the head 95*a* of the adjustment screw 95 is provided with a suitable internal drive recess, for example, a screwdriver slot 86, whereby the screw 95 can be rotated, as desired, to effect axial displacement thereof in either an up or down direction as desired, with reference to the FIGURE, whereby the force of the trim spring 87 can be varied, as desired.

The combined forces of springs 80 and 87 are preselected so as to obtain the desired biasing force against the armature/valve member 8 whereby to obtain the desired dynamic response thereof in its movement toward and away from the working force of the pole piece 20. To facilitate adjustment of this total biasing force, the force of spring 87 is preselected so that its force preferably constitutes about 50 percent or more of the total spring biasing force acting against the armature/valve member 8.

As illustrated, an O-ring seal 85 is positioned to encircle the shank portion 95*b* of the abutment screw 95 to effect a fluid tight seal between the screw and the bore wall 20*a* of the pole piece 20.

When the armature/valve member 8 is in its lowered position, as shown in the FIGURE, a working air gap is established between the lower end of the pole piece 20 and the upper end of the armature 70 by axial positioning of the spray tip 48 in the nozzle body 32, as desired, during flow calibration of the injector. Thereafter, the spray tip 48 can be fixed against rotation relative to the nozzle body 32, as by welding at the interface of these elements. As will be apparent, this flow calibration adjustment of the nozzle assembly is made before adjustment of the force of trim spring 87 in the manner described hereinabove.

It will be noted that during assembly of the injector 5, the valve 73 end of the armature/valve member, for example, can first be slidably positioned in the valve seat element 76 of the valve seat element 76, director plate 47 and spray tip 48 assembly. This assembly can then be inserted into the nozzle body 32 so that the ball guide socket 90 of the armature 70 will slidably receive the ball guide 81*b* portion of the armature stop and guide member 81 fixed to the pole piece 20, whereby the armature/valve member 8 is now, in effect, radially trapped and guided at opposite ends. Then, as the spray tip 48 is threaded axially upward, with reference to the FIGURE, so as to compress the spring 65, the radial position of the valve seat 46 will also, in effect, become radially fixed relative to the nozzle body.

Thereafter, as previously described, the spray tip 48 is axially positioned, as desired, during flow calibration of the injector to establish a working air gap between the pole piece and the upper end of the armature 70. However, as previously described, a minimum fixed working air gap will be established upon engagement of the guide stop seat 92 in the armature against the ball guide 81*b* portion of the armature stop and guide member 81 upon upward movement of the armature/valve member 8 during operation of the injector.

The embodiments of the invention in which an exclusive property or privilege is claimed are defined as follows:

1. An electromagnetic fuel injection valve including a housing means defining a generally cylindrical bore terminating at one end of a fuel discharge passage means located at a spray tip end of the housing means; a solenoid pole piece extending into said bore and being fixed at one end to said housing means at the opposite end of said bore from said spray tip end, said solenoid pole piece having a stepped bore therethrough with a portion thereof internally threaded, said solenoid pole piece terminating at its free end in a flat surface; an armature means having a valve member at one end thereof is operatively positioned in said bore for movement in valve opening and closing directions to open and close the fuel discharge passage means, the opposite end of said armature means having a central ball guide socket therein; said solenoid pole piece including a solenoid coil to effect movement of said armature means in one direction upon energization of said coil; a pivot member having a flat surface on one end thereof and being spherical opposite said flat surface, said pivot member being located so that said spherical end of the pivot member extends below said pole piece so as to be pivotally positioned in said ball guide socket with said flat surface thereof extending outwardly of said armature means for fixed engagement with said pole piece, said pivot member thus cooperating with said pole piece and said armature means to limit travel of said armature means in a valve opening direction.

2. An electromagnetic fuel injection valve including a housing means defining a generally cylindrical bore terminating at one end of a fuel discharge passage means located at a spray tip end of the housing means; a solenoid means including a solenoid pole piece extending into said bore, said pole piece being fixed at one end to said housing means at the opposite end of said bore from said spray tip end, said solenoid pole piece having a stepped bore therethrough with a portion thereof internally threaded, said solenoid pole piece terminating at its free end in a flat surface; and armature means having a valve member at one end thereof operatively positioned in said bore for movement in valve opening and closing direction to open and close the fuel discharge passage means, the opposite end of said armature means having a central ball guide socket therein; said solenoid pole piece including a solenoid coil to effect movement of said armature means in one direction upon energization of said solenoid coil; an armature guide and stop member having a cylindrical portion on one end thereof and having a spherical portion at its opposite end and having an axial opening therethrough, said armature guide and stop member being located having one end thereof fixed in said bore of said pole piece so that said spherical portion of said armature guide and stop member extends outward from said pole piece for pivotable and sliding engagement in said ball socket in said armature means, said armature guide and stop member thus cooperating with said pole piece and said armature means to guide one end thereof and to limit travel of said armature means in a valve opening direction; a spring means positioned in said housing means and operatively connected to said armature means to normally bias said armature means in a valve closing direction; and a trim spring positioned in said opening in said armature guide and stop member so as to abut at one end against said armature and at said opposite end against an externally accessible adjusting screw means threadedly received in said stepped bore of said pole piece.

* * * * *